US005570116A

United States Patent [19]

Soga

[11] Patent Number: 5,570,116

[45] Date of Patent: Oct. 29, 1996

[54] METHOD AND DEVICE FOR RESTORING INK JET PERFORMANCE OF INK JET RECORDING APPARATUS

[75] Inventor: Mitsuhide Soga, Kanagawa, Japan

[73] Assignee: Fuji Xerox Co., Ltd., Tokyo, Japan

[21] Appl. No.: 214,759

[22] Filed: Mar. 18, 1994

[30] Foreign Application Priority Data

Mar. 19, 1993 [JP] Japan ..... 5-085752

[51] Int. Cl.[6] ..... B41J 2/165

[52] U.S. Cl. ..... 347/30; 417/326

[58] Field of Search ..... 347/29, 30, 36; 417/42, 44.1, 45, 326

[56] References Cited

U.S. PATENT DOCUMENTS 4,739,340 4/1988 Terasawa ..... 346/1.1

5,164,748 11/1992 Katayanagi et al. ..... 346/140

FOREIGN PATENT DOCUMENTS 60-71259 4/1985 Japan .

60-159058 8/1985 Japan .

*Primary Examiner*—John E. Barlow, Jr.

*Attorney, Agent, or Firm*—Finnegan, Henderson, Farabow, Garrett & Dunner, L.L.P.

[57] ABSTRACT

A method of recovering ink jet performance of an ink jet recording apparatus, comprises the steps of: first covering a nozzle surface of an ink jet head with a cap; sucking the nozzle surface of the ink jet head to a vacuum by driving a variable vacuum suction pump for suction at a normal suction speed, the variable vacuum suction pump being connected to the cap through a communication member so as to communicate therewith; and thereafter driving the variable vacuum suction pump for idle suction at a speed that is lower than the normal suction speed with the cap moved away from the nozzle surface of the ink jet head.

7 Claims, 6 Drawing Sheets

METHOD AND DEVICE FOR RESTORING INK JET PERFORMANCE OF INK JET RECORDING APPARATUS

BACKGROUND OF THE INVENTION

The invention relates to a method and device for recovering ink jet performance of an ink jet recording apparatus employed during initial ink charging and maintenance. More particularly, the invention is directed to a novel method and device for recovering ink jet performance in which the performance of the ink jet recording apparatus for recovering waste ink discharged from the ink jet head is improved.

An ink jet performance recovering device is generally provided to maintain ink jet performance of an ink jet recording apparatus. The device is designed to remove dust, dried ink, bubbles, and the like found on the ink jet head side when ink is initially charged to the ink jet head or when the ink jet recording apparatus is maintained. The device includes, e.g., a cap for covering the nozzle surface of the ink jet head, a vacuum suction pump that is connected so as to communicate with the cap through a connection tube at the discharge outlet of the cap, and a waste ink tank, connected so as to communicate with the vacuum suction pump, for recovering the waste ink sucked by the pump.

Such an ink jet performance recovering device is so designed that the nozzle surface of the ink jet head is first covered with the cap and a vacuum suction force is then applied to the nozzle surface of the ink jet head to thereby allow the waste ink to be recovered from the ink jet head side.

However, a technical problem has been addressed by this ink jet performance recovering process. That is, the ink remains within the connection tube, causing clogging or the like with the ink.

To overcome this technical problem, arts disclosed in, e.g., Japanese Patent Unexamined Publications Nos. 60-71259 and 60-159058 are applied to a device, which is characterized as moving the cap away from the ink jet head after the ink jet performance recovering process has been performed, and under such condition, recovering the waste ink remaining within the connection tube positively by idly sucking the tube by the vacuum suction pump (the sucking operation under the same condition as in the ink jet performance recovering process). However, the waste ink remaining within the connection tube has not been recovered reliably. Thus, the technical problem that the waste ink remains within the connection tube has still been left unsolved.

SUMMARY OF THE INVENTION

The invention has been made to overcome the above technical problem. Accordingly, the object of the invention is to provide a method and device for recovering ink jet performance of an in jet recording apparatus in such a manner that the waste ink remaining within a waste ink flow path to the vacuum suction pump can be recovered without fail by causing the vacuum suction pump to idly suck the waste ink flow path under various conditions and finding out correlations between idle suction effected by the vacuum suction pump and the behavior of the waste ink remaining within the waste ink flow path to the vacuum suction pump.

To achieve the above object, a method of recovering ink jet performance of an ink jet recording apparatus according to the invention, comprises the steps of: first covering a nozzle surface of an ink jet head with a cap; sucking the nozzle surface of the ink jet head to a vacuum by driving a variable vacuum suction pump for suction at a normal suction speed, the variable vacuum suction pump being connected to the cap through a communication member so as to communicate therewith; and thereafter driving the variable vacuum suction pump for idle suction at a speed lower than the normal suction speed with the cap moved away from the nozzle surface of the ink jet head.

Further, a device for recovering ink jet performance of an ink jet recording head according to the invention comprises a cap having such a size as to cover a nozzle surface of an ink jet head; a cap opening/closing drive means for selectively opening and closing the nozzle surface of the ink jet head with the cap by moving the cap relative to the ink jet head; a variable vacuum suction pump connected to the cap through a communication member so as to communicate therewith; a waste ink tank, communicating with the variable vacuum suction pump, for recovering waste ink sucked by the variable vacuum suction pump; an ink jet performance recovering basic control means for driving the variable vacuum suction pump for suction at a normal suction speed with the nozzle surface of the ink jet head covered with the cap by the cap opening/closing drive means; and an ink jet performance recovering auxiliary control means for driving the vacuum suction pump for idle suction at a speed lower than the normal suction speed with the cap moved away from the nozzle surface of the ink jet head by the cap opening/closing drive means.

DETAILED DESCRIPTION OF THE PREFERRED EMBODIMENTS

The invention will now be described in detail based on embodiments thereof shown in the accompanying drawings.

Figure 1:
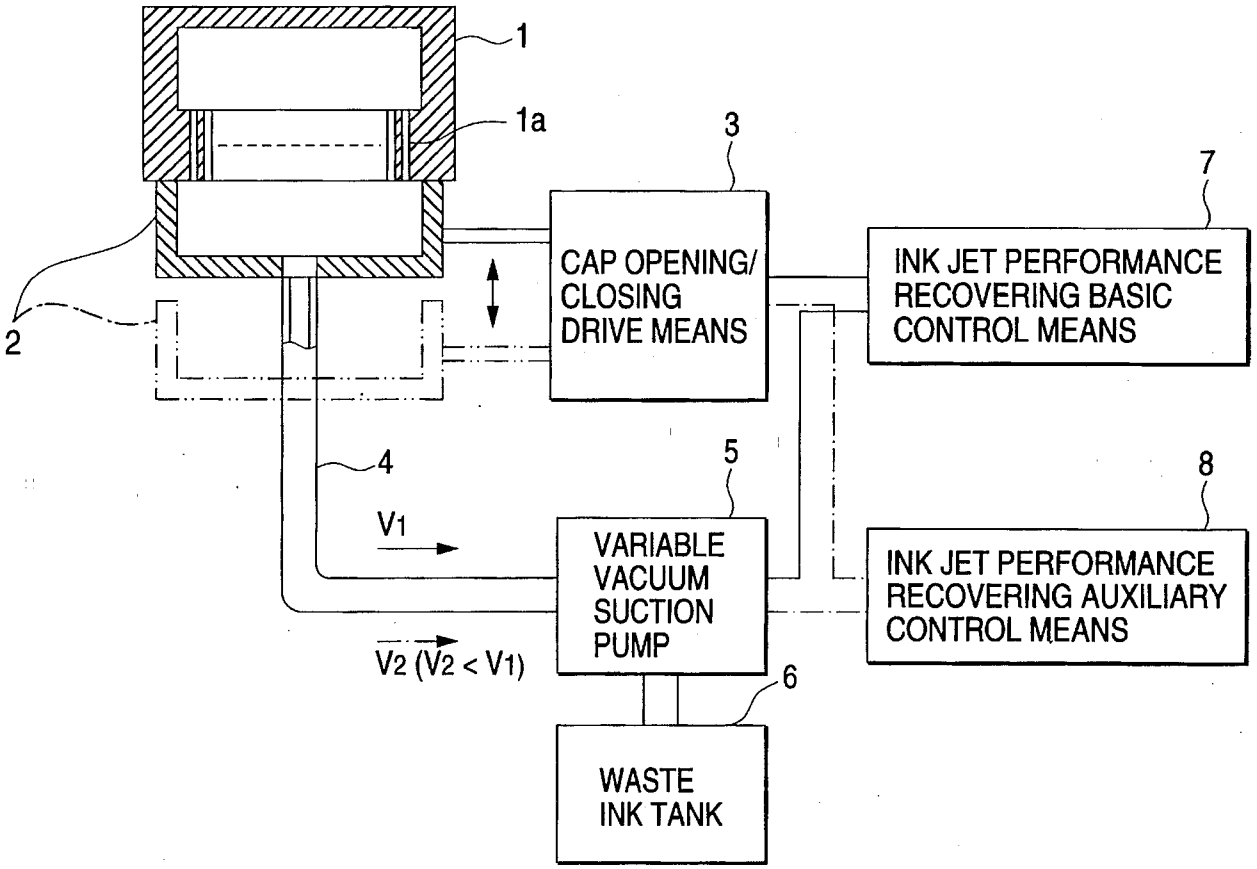
FIG. 1 is a diagram illustrative of a configuration of a method and device for restoring ink jet performance of an ink jet recording apparatus of the invention.

The invention is applied to a method of recovering ink jet performance of an ink jet recording apparatus. As shown in FIG. 1, the method involves the steps of: first covering a nozzle 1*a* surface of an ink jet head 1 with a cap 2; sucking the nozzle 1*a* surface of the ink jet head 1 to a vacuum by driving a variable vacuum suction pump 5 for suction at a normal suction speed v1, the variable vacuum suction pump 5 being connected to the cap 2 through a communication member 4 so as to communicate therewith; and thereafter driving the variable vacuum suction pump 5 for idle suction at a speed v2 that is lower than the normal suction speed v1 with the cap 2 moved away from the nozzle 1*a* surface of the ink jet head 1.

As shown in FIG. 1, a device that embodies the above-mentioned method includes: a cap 2 that is of such a size as to cover a nozzle 1*a* surface of an ink jet head 1; a cap opening/closing drive means 3 for selectively opening and closing the nozzle la surface of the ink jet head 1 with the cap 2 by moving the cap 2 relative to the ink jet head 1; a variable vacuum suction pump 5 connected to the cap 2 through a communication member 4 so as to communicate therewith; a waste ink tank 6, communicating with the variable vacuum suction pump 5, for recovering waste ink sucked by the variable vacuum suction pump; an ink jet performance recovering basic control means 7 for driving the variable vacuum suction pump 5 for suction at a normal suction speed v1 with the nozzle 1*a* surface of the ink jet head 1 covered with the cap 2 by the cap opening/closing drive means 3; and an ink jet performance recovering auxiliary control means 8 for driving the vacuum suction pump 5 for idle suction at a speed v2 that is lower than the normal suction speed v1 with the cap 2 moved away from the nozzle 1*a* surface of the ink jet head 1 by the cap opening/closing drive means 3.

In such technical means, the variable vacuum suction pump 5 may be selected appropriately as long as the suction speed thereof is variable.

In this case, it is preferable that the suction speed of the vacuum suction pump 5 controlled by the ink jet performance recovering basic control means 7 be such that a predetermined vacuum can be applied to the nozzle 1*a* surface of the ink jet head 1, and further be high from the viewpoint of reducing ink consumption. That is, a larger amount of suction of the pump per unit time (suction speed of the pump) is better to reduce ink consumption. On the other hand, with respect to the suction speed of the vacuum suction pump 5 controlled by the ink jet performance recovering auxiliary control means 8, it is necessary to select a range so that the waste ink remaining within the communication member 4 can be moved without fail.

The operation timing of the ink jet performance recovering auxiliary control means 8 may be interlocked with the operation timing of the ink jet performance recovering basic control means 7, or may be set to an arbitrary timing independent of the operation timing of the ink jet performance recovering basic control means 7, such as during the print operation.

Further, from the viewpoint of reducing the ink jet performance recovering process time, it is preferable to select as the variable vacuum suction pump 5 a pump whose piston return speed can also be varied and to cause the ink jet performance recovering auxiliary control means 8 to control the piston return speed of the variable vacuum suction pump 5 from the lower dead point to the upper dead point so as to be lower than a normal piston return speed controlled by the ink jet performance recovering basic control means 7.

According to the above-mentioned technical means, the ink jet performance recovering basic control means 7 drives the variable vacuum suction pump 5 for suction at the normal suction speed v1 with the nozzle 1*a* surface of the ink jet head 1 covered with the cap 2 by the cap opening/closing drive means 3.

At this time, a predetermined vacuum suction force is applied to the nozzle 1*a* surface of the ink jet head 1 to allow the waste ink sucked and discharged from the ink jet head 1 to be recovered to the waste ink tank 6 through the cap 2, the communication member 4, and the variable vacuum suction pump 5.

Further, the ink jet performance recovering auxiliary control means 8 drives the variable vacuum suction pump 5 for idle suction at the speed v2 that is lower than the normal suction speed v1 with the cap 2 moved away from the nozzle 1*a* surface of the ink jet head 1 by the cap opening/closing drive means 3.

At this time, the waste ink remaining within the communication member 4 is moved slowly as well as surely toward the variable vacuum suction pump 5 and recovered to the waste ink tank 6 through the variable vacuum suction pump 5.

Figure 2:
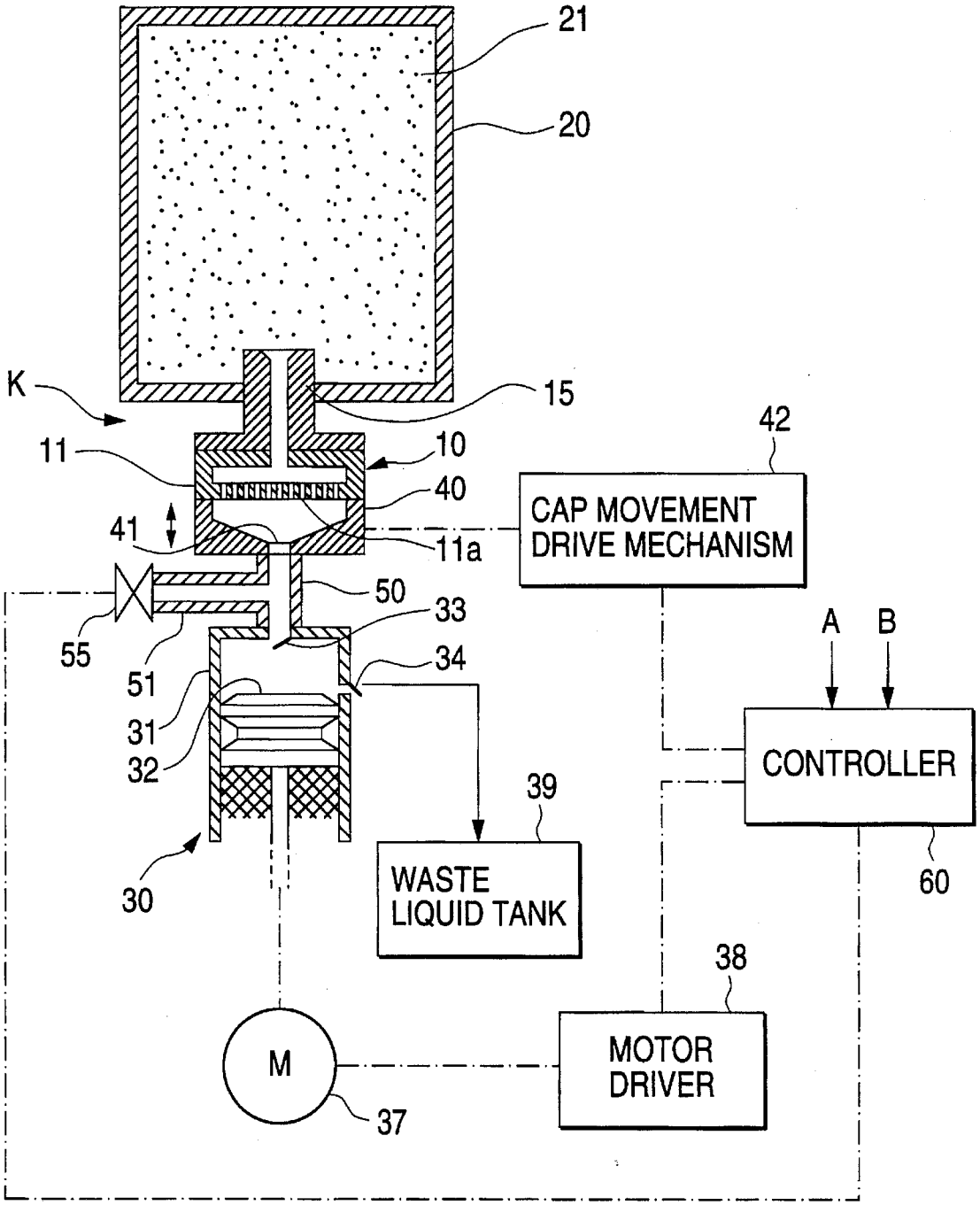
FIG. 2 is a diagram illustrative of an embodiment of the device for restoring ink jet performance of the ink jet recording apparatus to which the invention is applied.
Figure 3:
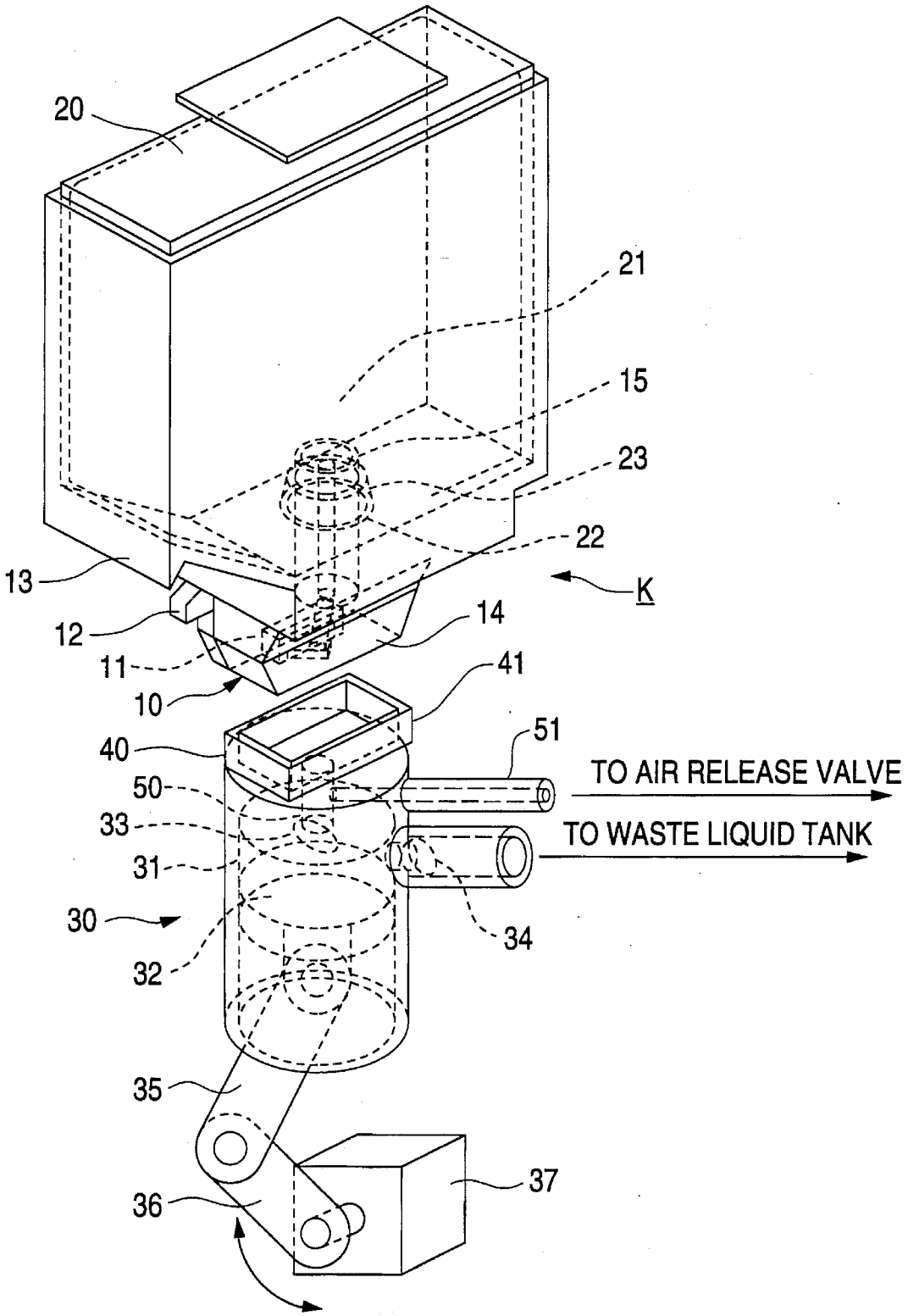
FIG. 3 is a perspective view showing the embodiment of FIG. 2.

FIGS. 2 and 3 show an embodiment of a device for restoring ink jet performance of an ink jet recording apparatus to which the invention is applied.

In FIGS. 2 and 3, reference character K designates an ink jet cartridge, which includes an ink jet head 10 and an ink tank 20.

The ink jet head 10 has a head body 11, a heat sink 12; a tank receiving case 13, and a manifold 14. The head body 11 includes, e.g., ink jet nozzles 11*a* formed every pixel density and built-in heating resistors within the respective nozzles 11*a*. Ink jet thermal energy is applied to the heating resistors in accordance with an image signal. The heat sink 12 fixes the head body 11 in position and radiates remaining heat of the head body 11. The tank receiving case 13 is mounted on the heat sink 12 to receive and hold the ink tank 20. The manifold 14 uniformly supplies ink to the head body 11. Each heating resistor of the head body 11 receives a drive signal from a not shown print control board through a not shown connector.

Further, in this embodiment, a cylindrical joint 15 is projected from the manifold 14. The joint 15 is inserted into and coupled with a joint opening 22 (described later) of the ink tank 20. Still further, the manifold 14 and the heat sink 12 surround the nozzle 11*a* surface of the head body 11 to form surfaces of abutment for a cap 40 (described later).

On the other hand, the ink tank 20 of the embodiment contains a felt member 21 that keeps the ink impregnated by capillary force. On the bottom wall of the ink tank 20 is the joint opening 22. On the periphery of the joint opening 22 is a flange 23 that projects toward the inside of the ink tank 20 so that the cylindrical joint 15 can be guided thereto. If the cylindrical joint 15 is inserted into the joint opening 22, the felt member 21 and the cylindrical joint 15 are fluidly coupled with each other.

In FIGS. 2 and 3, reference numeral 30 designates a displacement vacuum suction pump, which includes: a cylinder 31; a piston 32 that works up and down; a one-way valve 33 that opens the suction port of the vacuum suction pump 30 only during the suction stroke; and a one-way valve 34 that opens a communication port toward a waste liquid tank 39 only when the piston 32 is in the return stroke.

The piston 32 is connected to a drive motor 37 through links 35, 36, and moves up and down by the rotation of the drive motor 37.

Particularly in this embodiment, a controller 60 controls a motor driver 38 in accordance with a basic control mode for restoring ink jet performance (hereinafter referred to as "mode A" in this embodiment) and an auxiliary control mode for recovering ink jet performance (hereinafter referred to as "mode B" in this embodiment), so as to set a suction drive speed of the drive motor 37 (equivalent to a suction speed of the pump) variably.

Specifically, the displacement of the vacuum suction pump 30 from the upper dead point to the lower dead point is about 0.4 cc. The suction drive speed of the drive motor 37 is set to 0.2 cc/sec when, e.g., mode A is selected, and the suction drive speed of the drive motor 37 is set to 0.1 cc/sec when mode B is selected.

Further, in this embodiment, the drive motor 37 return drive speed (equivalent to the piston 32 return speed) in mode B is 0.4 cc/sec, which is faster than the normally set speed in mode A (e.g., 0.2 cc/sec).

The cap 40 is connected to the vacuum suction pump 30 through a communication tube 50 so that the cap can communicate with the pump.

The cap 40 is made of a rubber material in such a size as to cover at least the nozzle 11*a* surface of the ink jet head 10. On the bottom of the cap 40 is an ink discharge outlet 41 that communicates with the communication tube 50. The cap 40 is supported by a cap movement drive mechanism 42 that is moved up and down by, e.g., a cam, an electromagnet, or the like.

In this embodiment, the cap movement drive mechanism 42 is designed to be controlled by the controller 60 in the following manner. The cap 40 is moved up in mode A so as to abut against the periphery of the nozzle 11*a* surface of the ink jet head 10 to close the nozzle 11*a* surface (capping operation), whereas the cap 40 is moved down in mode B so as to move away from the nozzle 11*a* surface of the ink jet head 10.

Further, in this embodiment, the communication tube 50 is formed of a silicon tube whose inner diameter is, e.g., 1 mm, and a branch tube 51 to an air release valve 55 is formed on a part of the communication tube 50, so that the air release valve 55 can release air based on a signal from the controller 60 at the time the cap 40 starts the capping operation. The air releasing operation is to prevent the ink within the nozzles 11*a* from being pushed back into the nozzles with the cap 40 under positive pressure at the time of the capping operation.

An operation of the ink jet performance recovering device of the ink jet recording apparatus according to the embodiment will be described next.

To cause the device to perform the basic control operation for recovering ink jet performance, a mode A selection signal may be applied to the controller 60.

In this case, the controller 60 causes the cap 40 to perform the capping operation with the air release valve 55 opened.

Upon completion of the capping operation by the cap 40, the controller 60 closes the air release valve 55 and causes the vacuum suction pump 30 to operate thereafter through the motor driver 38 at a normal suction speed (0.2 cc/sec in this embodiment).

Then, a predetermined vacuum suction force acts on the nozzle 11*a* surface of the ink jet head 10, so that the waste ink from the ink jet head 10 is sucked into the vacuum suction pump 30 through the cap 40 and the communication tube 50 and the waste ink within the vacuum suction pump 30 is recovered to the waste liquid tank 39 in accordance with the piston 32 return operation by the vacuum suction pump 30.

Under this operation condition, it is verified that the waste ink still remains within the communication tube 50.

To clean the waste ink remaining within the communication tube 50, a mode B selection signal may be applied to the controller 60 so that the auxiliary control operation for recovering ink jet performance can be performed.

In this case, the controller 60 releases the capping operation performed by the cap 40 (causes the cap 40 to move away from the nozzle 11*a* surface of the ink jet head 10) and then causes the vacuum suction pump 30 to effect idle suction at a suction speed (0.1 cc/sec in this embodiment) that is lower than the normal suction speed (0.2 cc/sec in this embodiment).

As a result, the waste ink remaining within the communication tube 50 moves toward the vacuum suction pump 30 slowly but steadily, so that the waste ink within the vacuum suction pump 30 can be recovered to the waste liquid tank 39 in accordance with the piston 32 return operation by the vacuum suction pump 30.

The suction speed of the vacuum suction pump 30 is varied between mode A and mode B in this embodiment. Such speeds are selected based on, e.g., the following teat results.

Figure 4:
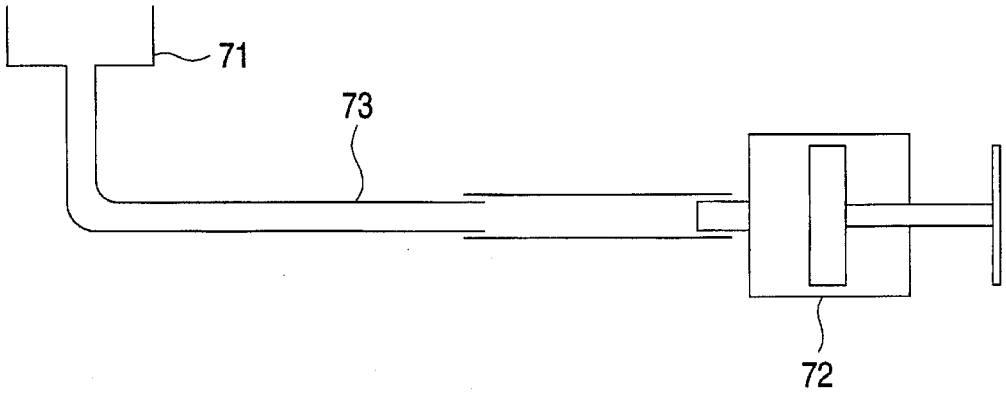
FIG. 4 is a diagram illustrative of a measurement flow path used in selecting a pump suction speed of the device for restoring ink jet performance, which is the embodiment.

Using a measurement flow path such as shown in FIG. 4 and connecting a cap 71 to a vacuum suction pump 72 having a 1-cc cylinder through a 1-mm silicon tube 73 so that the cap communicates with the pump, a correlation among the suction speed of the vacuum suction pump 72 (the amount of suction of the pump per unit time), the amount of change in the stroke of the piston (the amount of suction of the pump), and the amount in which the ink within the silicon tube 73 is moved was evaluated. The capacity of the flow path was set to about 0.81 CC.

Figure 5:
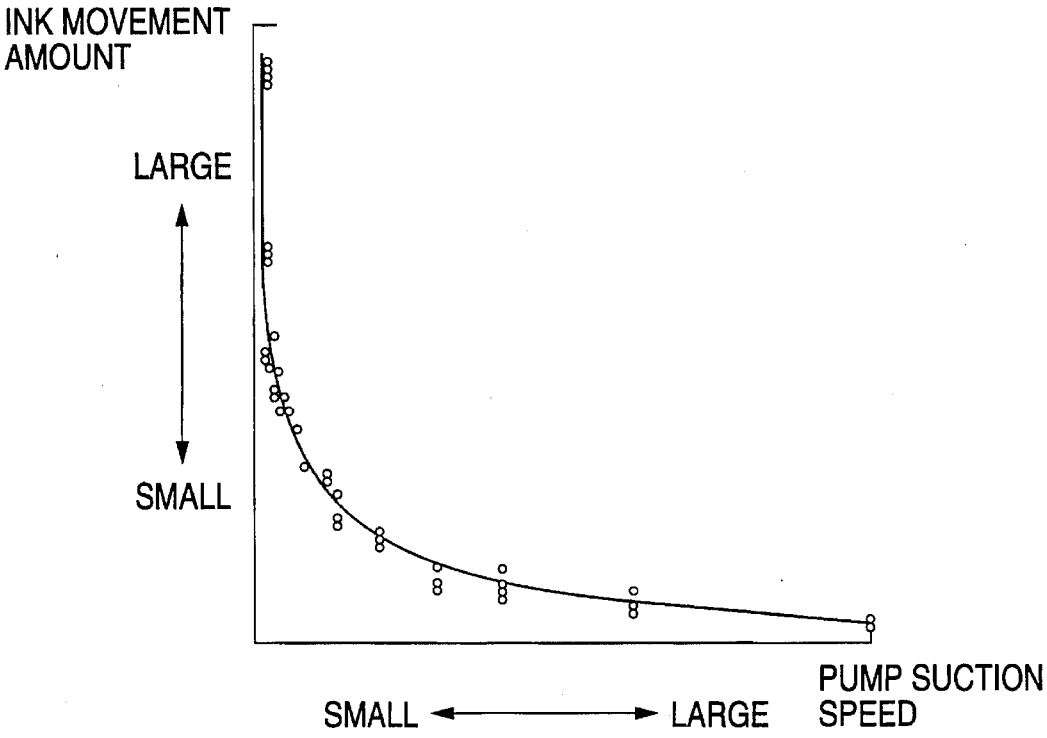
FIG. 5 is a graph showing a relationship between the pump suction speed and the amount in which the ink is moved obtained from the measurement flow path of FIG. 4.
Figure 6:
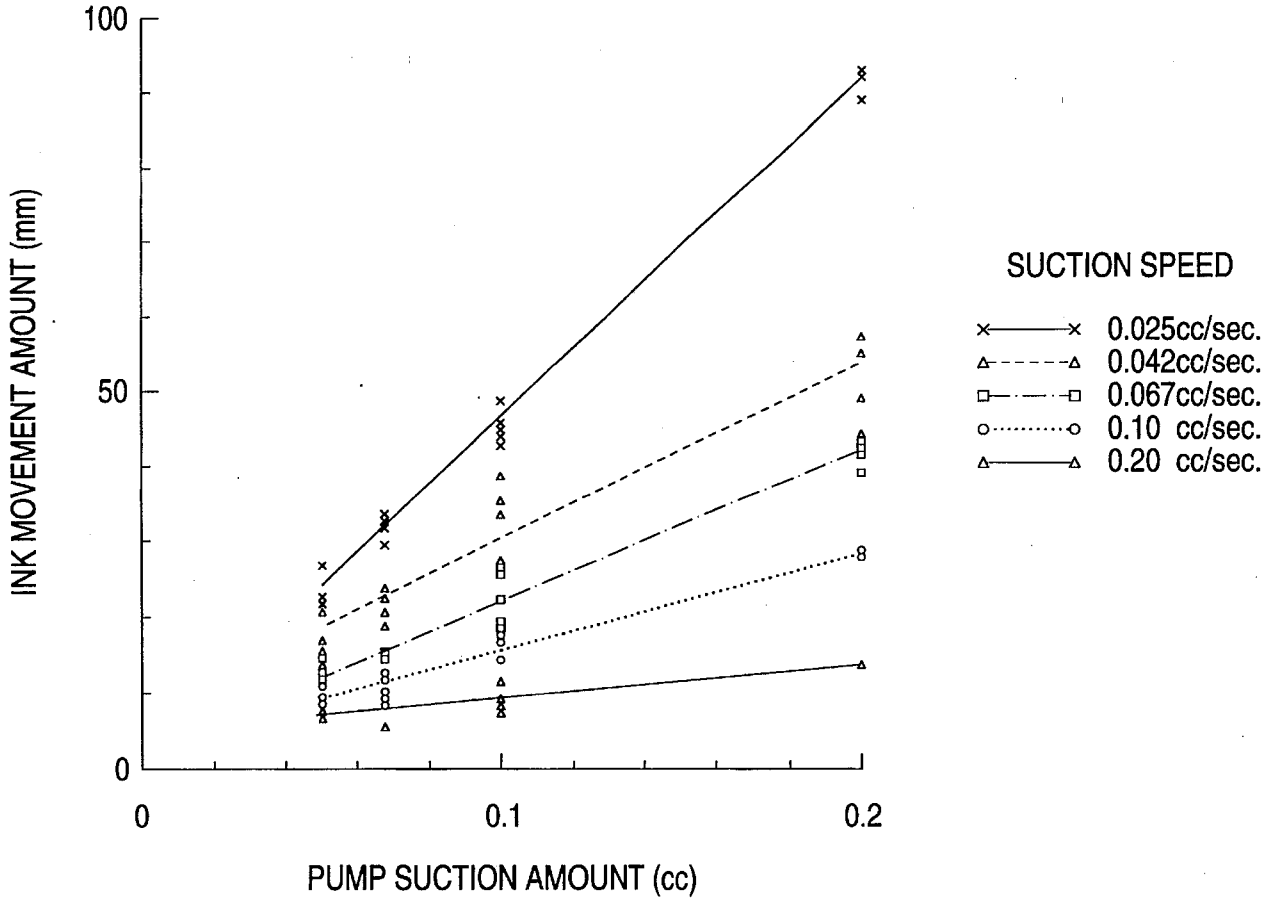
FIG. 6 is a graph showing a relationship between the amount of suction of the pump and the amount in which the ink is moved obtained from the measurement flow path of FIG. 4 with the pump suction speed as a parameter.

The results are shown in FIGS. 5 and 6.

FIG. 5 shows the suction speed of the pump versus the amount in which the ink is moved, and FIG. 6 shows the amount of suction of the pump versus the amount in which the ink is moved with the suction speed of the pump as a parameter.

It is understood from FIG. 5 that the amount in which a column of ink within the silicon tube 73 is moved is inversely proportional to the suction speed of the pump, whereas it is understood from FIG. 6 that the amount in which a column of ink within the silicon tube 73 is moved is proportional to the amount of suction of the pump.

Hence, the suction speed of the pump may be selected appropriately by considering the amount of suction of the pump. It is the above-mentioned suction speeds that were selected in this embodiment.

The relationship between the suction speed and the maximum value of decompression within a suction space formed between the nozzle surface and the gap is calculated by simulation thereby obtaining the results indicated by the following table.

TABLE

| SUCTION SPEED [cc/sec] | SUCTION TIME [sec] | MAXIMUM DECOMPRESSION VALUE [Pa] |
|---|---|---|
| 0.05 | 8 | −10280 |
| 0.10 | 4 | −16700 |
| 0.15 | 2.67 | −20040 |
| 0.20 | 2 | −21990 |
| 0.30 | 1.33 | −24130 |
| 0.40 | 1 | −25280 |

Figure 7:
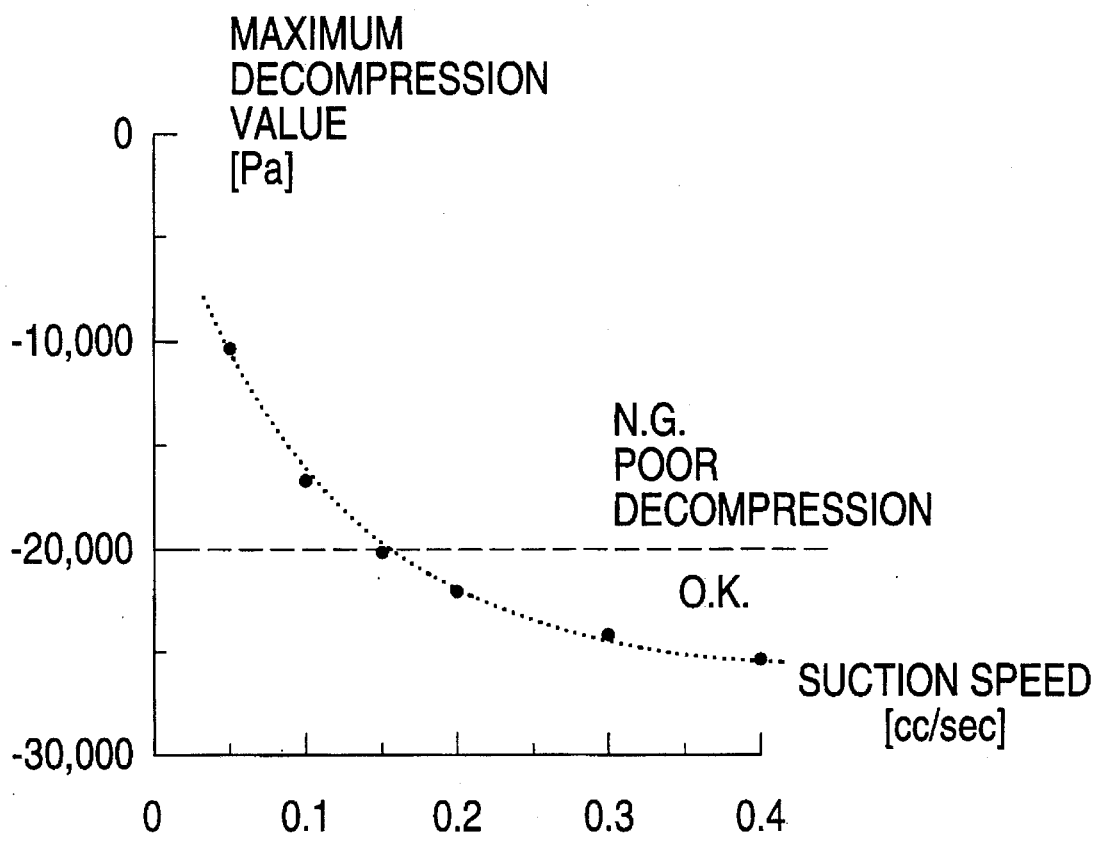
FIG. 7 is a graph showing a relationship between the suction speed and the maximum decompression value.

From this table, it is found that the suction speed and the maximum decompression value are inversely proportional to each other. This relationship is shown in FIG. 7. The decompression condition necessary for performing the ink suction sufficient to recovery the ink jet performance when the cap is closed was obtained with the fixed condition in which the suction space volume is 1 cc while the suction quantity is 0.4 cc at the time of the suction start. As a result of experiment, it was found that it is necessary to reduce the pressure within the suction space to 20,000 Pa or less. This decompression necessary condition is substantially constant even when the suction space volume and the suction quantity are changed. This relationship is shown in FIG. 7. Therefore, in this embodiment, that is, when the suction space volume is 1 cc, it is preferable to set the suction speed to 0.15 cc/sec or more. In the range where the space volume is not largely changed from 1 cc, it is also preferable to set the suction speed to the minimum suction speed resulting from multiplying the suction speed of 0.15 cc/sec by the space volume ratio.

As is apparent from the table, as the suction speed rises, the maximum decompression value increases more. The suction speed of 0.4 cc/sec is advantageous to reduction of the suction time, and the suction speed can be properly set on the basis of the speed setting range or the like in view of the drive motor performance.

As described in the foregoing, the first and the second aspects of the invention are directed to an ink jet performance recovering process and designed to ensure the recovery of the remaining waste ink by performing idle suction that is optimal in recovering the remaining waste ink within the flow path of the ink jet performance recovering device. Therefore, events in which the waste ink remains within the flow path of the ink jet performance recovering device can be avoided for sure, thereby preventing clogging with the ink or the like.

Moreover, the process of recovering the waste ink remaining in the flow path of the ink jet performance recovering device can be performed at an arbitrary timing independently of the print operation, thereby allowing the remaining waste ink recovering process on the side of the ink jet performance recovering device to be performed without affecting the print speed.

The third aspect of the invention, in particular, allows the time required for recovering the waste ink remaining in the flow path of the ink jet performance recovering device to be shortened by contriving the return operation of the vacuum suction pump.

What is claimed is:

1. A method of recovering ink jet performance of an ink jet recording apparatus, comprising the steps of:

covering a nozzle surface of an ink jet head with a cap;

then sucking the covered nozzle surface of said ink jet head to a vacuum by driving a variable vacuum suction pump for suction at a first suction speed, the variable vacuum suction pump being connected to said cap through a communication member so as to communicate therewith; and then driving the variable vacuum suction pump for idle suction at a second suction speed lower than said first suction speed with said cap moved away from the nozzle surface of said ink jet head.

2. A device for recovering ink jet performance of an ink jet recording head, comprising:

a cap for covering a nozzle surface of an ink jet head;

a cap opening/closing drive means for selectively opening and closing the nozzle surface of said ink jet head with said cap by moving said cap relative to said ink jet head;

a variable vacuum suction pump connected to said cap through a communication member so as to communicate therewith;

a waste ink tank, communicating with said variable vacuum suction pump, for recovering waste ink sucked by said variable vacuum suction pump;

an ink jet performance recovering basic control means for driving said variable vacuum suction pump for suction at a first suction speed when the nozzle surface of said ink jet head is covered with said cap by said cap opening/closing drive means; and an ink-jet performance recovering auxiliary control means for driving said vacuum suction pump for idle suction at a second suction speed lower than said first suction speed when said cap is moved away from the nozzle surface of said ink jet head by said cap opening/closing drive means.

3. A device for recovering ink jet performance of an ink jet recording head according to claim 2, wherein said variable vacuum suction pump has a variable piston return speed, and said ink jet performance recovering auxiliary control means controls the piston return speed of said variable vacuum suction pump from a lower dead point to an upper dead point so as to be lower than a normal piston return speed controlled by said ink jet performance recovering basic control means.

4. A method of recovering ink jet performance of an ink jet recording apparatus according to claim 1, wherein a suction space is formed between said nozzle surface and said cap when said nozzle surface is covered by said cap and, said first suction speed is a suction speed at which said suction space is set to a decompression state of −20,000 Pa or less.

5. A method of recovering ink jet performance of an ink jet recording apparatus as claimed in claim 4, wherein said first suction speed is 0.15 cc/sec or more.

6. A device for recovering ink jet performance of an ink jet recording head according to claim 2, wherein a suction space is formed between said nozzle surface and said cap, and said first suction speed is a suction speed at which said suction space is set to a decompression state of −20,000 Pa or less.

7. A device for recovering ink jet performance of an ink jet recording head according to claim 6, wherein said first suction speed is 0.15 cc/sec or more.

* * * * *